United States Patent [19]

Hirayama

[11] 3,952,674

[45] Apr. 27, 1976

[54] METHOD AND APPARATUS FOR ADJUSTING THE LOOPER OPERATION LOCUS OF A SEWING MACHINE

[75] Inventor: Tetsuro Hirayama, Tokyo, Japan

[73] Assignee: Juki Co., Ltd., Tokyo, Japan

[22] Filed: Nov. 14, 1974

[21] Appl. No.: 523,707

[30] Foreign Application Priority Data

Nov. 16, 1973 Japan ..... 48-132573

[52] U.S. Cl. ..... 112/199

[51] Int. Cl.[2] ..... D05B 1/06

[58] Field of Search ..... 112/119, 120, 197, 198, 112/162, 199

[56] References Cited

UNITED STATES PATENTS 2,811,940 11/1957 Marforio ..... 112/199

3,670,677 6/1972 Hirayama ..... 112/119

FOREIGN PATENTS OR APPLICATIONS 493,968 3/1930 Germany ..... 112/200

*Primary Examiner*—Alfred R. Guest

*Attorney, Agent, or Firm*—Basile and Weintraub

[57] ABSTRACT

The upper looper of a sewing machine is held and guided in its intermediate part by a looper guide movable therewith in the lengthwise direction. The guide rotates around a shaft upon which a rotary carriage is journalled, and is movable in a direction intersecting with the looper guiding direction, with respect to the carriage. The looper is carried on its other end by a reciprocally rotatable rocking arm. The other end of the rocking arm is connected to a driving rod which is driven by a driving shaft.

7 Claims, 4 Drawing Figures

METHOD AND APPARATUS FOR ADJUSTING THE LOOPER OPERATION LOCUS OF A SEWING MACHINE

BACKGROUND OF THE INVENTION

1. Field of the Invention

This invention relates to a method and apparatus for adjusting the looper operation locus of a sewing machine. More particularly, the present invention provides an overlocking sewing machine using upper and lower loopers with a means wherein a looper guide, holding and guiding the upper looper, is engaged and held so as to be movable in a direction intersecting the guiding direction of the looper with a rotary carriage rotatably set with a pivot. Even more particularly, the present invention concerns a looper operation locus for sewing thin things having only the upper dead center shifted from a position near a needle plate to a higher position by deviating and moving only the looper guide without moving the pivot of the rotary carriage, and while keeping the displacement of the initial position of the upper looper as small as possible.

2. Prior Art

Generally the upper looper of an overlocking sewing machine makes on overedge motion from below its needle plate to above the needle plate. This motion locus must be properly selected depending on the thickness of the texture to be sewn.

When sewing a thick texture, the tip of the upper looper must be positioned away above the upper surface of the needle plate. However, when sewing a thin texture, the tip of the upper looper must be positioned near above the upper surface of the needle plate. This adjustment is made by a careful investigation of the geometrical formation in the motion mechanism of the looper. But it is very difficult to determine a new proper looper motion locus.

As a result there exists a need for a structure for obtaining some favorable looper operation loci.

To this end the present invention is directed to means and methods for changing the height of the upper dead center while keeping the displacement of the initial position, i.e., the lower dead center of the upper looper, as small as possible so that the misconnections of the thread produced when the upper looper makes a relay with the lower looper at the lower dead center may be reduced.

OBJECTS OF THE INVENTION

Accordingly, an object of the present invention is to provide a looper locus adjusting means for converting the operation locus of the upper looper in conformity with a thick sewing and thin sewing.

Another object of the present invention is to obtain a looper operation locus such that the position in which the lower dead center of the upper looper intersects with the needle is high, while keeping the displacement of the relay position with respect to the lower looper as small as possible.

A further object of the present invention is to positively obtain a movement, in an allowable range, of the lower dead center of the upper looper in the relay of the lower looper and upper looper during the adjustment of the looper operation locus.

BRIEF DESCRIPTION OF THE DRAWINGS

In the accompanying drawings explaining the present invention wherein like reference characters refer to like parts through the several views.

DETAILED DESCRIPTION OF THE PREFERRED EMBODIMENT

Figure 1:
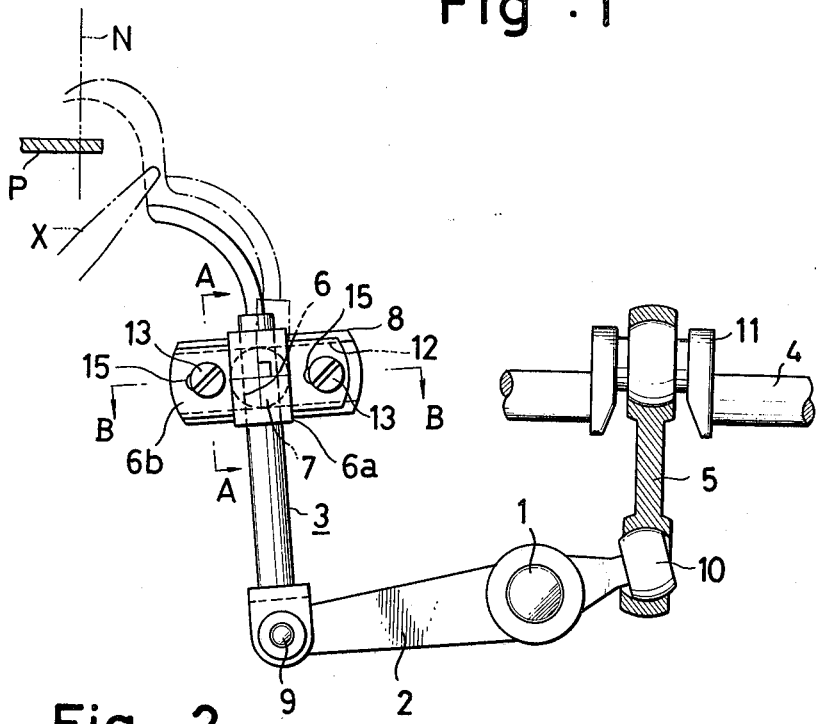
FIG. 1 is an elevational view of the present invention.

Referring now to the drawings, a looper 3 is connected and carried like a link in the end part of a rocking arm 2. A driving rod 5, connected with a driving shaft 4 and rocking forward and rearward, is connected, like a link, with the rocking arm 2 so that the rocking arm 2 may rotate to reciprocate like a seesaw. The looper 3 is held in the intermediate part so as to be movable in the lengthwise direction with a looper guide 6 in the lengthwise direction of the looper. The looper guide 6 is engaged so as to be movable and adjustable in a direction intersecting with the looper guiding direction, with respect to a rotary carriage 8 rotatably set with a shaft 7.

In FIG. 1, the rocking arm 2 is pivoted in the intermediate part, like a seesaw, with a pivot 1 and is connected at one end with the looper 3, like a link, via pin 9.

The driving rod 5 is connected by connecting means, such as a ball joint 10, at the other end of the rocking arm 2. The driving rod 5 is connected at its other end with a rocking device or means 11 such as, for example, a crank formed on the driving shaft 4.

When the driving shaft 4 rotates, the driving rod 5 will rock forward and rearward to rock the rocking arm 2, like a seesaw, around the pivot 1 as a center.

As above noted, the looper 3 is connected and carried at its lower end, like a link, at one end of the rocking arm 2. The looper 3 is held in the intermediate part so as to be slidable in the lengthwise direction with the looper guide 6.

As illustrated in the drawings, the looper guide 6 has a hole-shaped holding guide **6*a* through which the looper 3 is inserted and held. It is to be understood, however, that the holding guide 6*a* need not always be hole-shaped. Any structure holding the looper 3 so as to be free only in the lengthwise direction can be adopted for the looper guide 6**.

Referring, again, to the drawings, the looper guide 6 has a sliding plate **6*b* carrying the holding guide 6*a*. The looper guide 6 is slidably and fixably fitted to the rotary carriage 8 through the holding guide 6*b***.

The rotary carriage 8 is set in a proper place of the sewing machine body through the shaft 7 so as to be rotatable around the shaft as a center. The rotary carriage is integrally formed with the shaft 7.

Figure 2:
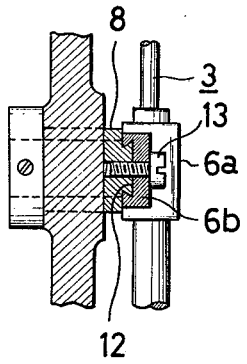
FIG. 2 is a cross-sectional view taken along line A—A of FIG. 1.
Figure 3:
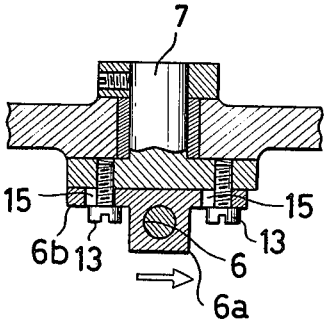
FIG. 3 is a cross-sectional view taken along line B—B of FIG. 1.

A typical means of fitting the looper guide 6 to the rotary carriage 8 through the sliding plate **6*b* is a T-shaped groove engagement or a dovetail groove engagement as is shown in FIGS. 1 to 3**.

The dovetail groove is formed in the sliding plate **6*b*, and is denoted by a numeral 12. The groove 12 extends in the lateral direction. The sliding plate 6*b* engages and holds the rotary carriage 8 through a complementary projection formed on the carriage and this dovetail groove 12** so as to be relatively slidable and displaceable in the lateral direction.

The looper 3 is inserted from below to above through the guide hole 6*a* of the looper guide 6 so that the guide hole 6*a* may be directed up and down and the looper guide 6 may be movable in the direction intersecting with the guiding direction of the looper 3.

Preferably, when the looper 3 is placed in the initial position, i.e., the lower dead center of the operation, the dovetail groove 12 is laterally set in the direction intersecting at right angles with the looper 3.

As shown in FIGS. 1 to 3, a set screw is screwed into the rotary carriage 8. Slots 15 corresponding, respectively, to the set screws 13 are provided in the sliding plate 6*b* of the looper guide 6 so that the looper guide 6 may be fixed to the rotary carriage 8 through these set screws and slots. Thus, the looper guide 6 can move in the direction indicated by the arrow in FIG. 3 by the length of the slots 15 with respect to the rotary carriage 8.

As shown in FIGS. 1 and 3, the guide hole 6*a* of the looper guide 6 is on the shaft 7 of the rotary carriage 8. In such state, when the rocking arm 2 rocks up and down, the looper 3 will move up and down and the looper guide 6 will reciprocate by a half rotation to the right and left on the shaft 7.

At this time, the tip of the looper 3 will trace the locus as shown by the broken line in FIG. 1, and will intersect with the needle N in a position near the needle plate P so as to be adapted to sewing thin things.

However, when the looper guide 6 is moved and fixed in the direction indicated by the arrow in FIG. 3, the looper 3 will trace the locus shown by the one-dot chain line in FIG. 1 and will intersect with the needle N in a position high away from the needle plate P so as to be adapted to sewing thick things.

Such adjustment of the up and down movement of the tip of the looper 3 is attained by deviating the pivotal point of the looper guide, i.e., the shaft 7 in this invention, in the direction of the arrow in FIG. 3, which intersects with the looper 3 guiding direction.

However, when moving the shaft itself, the displacement of the initial position of the looper 3 will be so great that the connection with the lower looper X will deteriorate. Therefore, in a system of moving only the looper guide 6 while fixing the shaft as is, as contemplated herein, even if the displacement is small, the height of the position of the upper dead center of the looper 3 will be taken to be sufficient.

Figure 4:
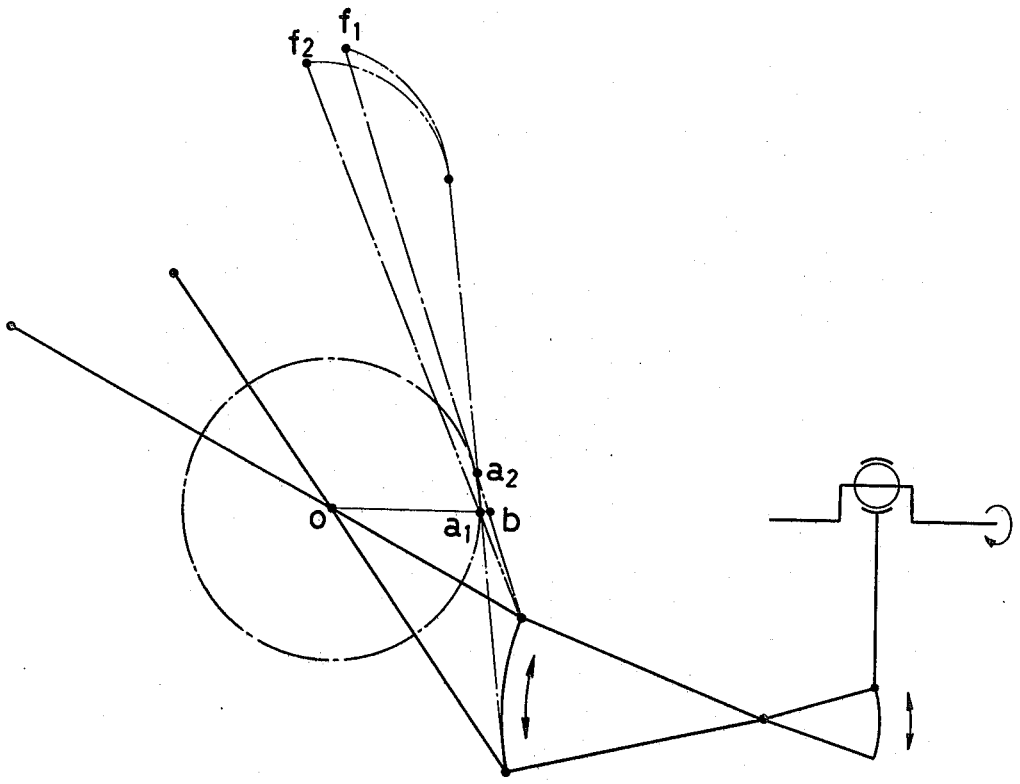
FIG. 4 is a diagram explaining the principle upon which the present invention is based.

This is more clearly explained with reference to FIG. 4. The point O represents the center of the shaft 7. If the looper guide 6 is placed on the shaft 7, at the point O, because of the rocking of the rocking arm 2, the looper 3 will move from the lower dead center to the upper dead center as shown by the solid line. However, if the part holding the looper 3 in the intermediate part, i.e., the looper guide 6, is now moved from the point O to the point $a_1$ and is fixed thereat and the point O, i.e., the shaft 7 is set as is, when the rocking arm 2 moves to the upper dead center, the looper guide 6, as indicated as the point $a_1$, will rotate and move to the point $a_2$ and the tip of the looper 3 will come to a higher position $f_1$.

This means that when the shaft 7 is fixed at the point O and only the looper 3 holding point, i.e., the looper guide 6 is moved, the looper guide 6 will rotate around the shaft 7, as a center, and move from the point $a_1$ to the point $a_2$. However, in a prior art system in which the looper guide is moved by moving the shaft 7, in order to obtain the higher position $f_2$ at the upper dead center of the tip of the looper, the looper guide 6 will have to be placed at the point *b*, together with the shaft 7. At such time, the looper 3 will not pass through the point $a_1$. If the looper guide is set on the point $a_1$, only lower looper point $f_2$ of the tip of the looper can be obtained.

Since the line segment *ob* is larger than the line segment $oa_1$, as seen in the diagram, the amount by which the initial position of the tip of the looper 3 slips in the direction of the above mentioned line segments will be larger when the looper 3 holding point, that is, the looper guide 6, is moved to the point *b* than when the shaft 7 is left as it is and only the looper guide 6 is moved to the point $a_1$. Even if the looper guide 6 is moved in the direction reverse to that in the drawing, depending on the setting of the position of the connecting part in which the rocking arm 2 carries the looper, there will be the same effect.

Thus, according to the present invention, the variation of the initial position of the looper tip may be small and the connection with the lower looper is positive.

Having, thus, described the invention, what is claimed is:

1. An apparatus for adjusting the looper operation locus of a sewing machine, comprising:

a. a shaft, b. a rotary carriage integrally formed with the shaft, c. a looper guide, d. means for slidably fixably mounting the looper guide on the rotary carriage, e. a looper guided and supported by the looper guide at an intermediate section thereof, f. a reciprocally rotatable rocking arm having the looper connected thereto in the end part thereof, g. a rotatable driving shaft, h. a driving rod connected to the driving shaft at one end thereof and rocking forward and rearward, the driving rod being connected at its other end to the rocking arm to reciprocally rotate the arm, and wherein the looper is held in the intermediate part and moves in its lengthwise direction while supported by the looper guide, the guide being movable and adjustable in a direction intersecting with the looper guiding direction with respect to the carriage.

2. The apparatus of claim 1 wherein the looper guide comprises:

a. a holding guide through which the looper is inserted, and b. a sliding plate carrying the holding guide, the sliding plate slidably fitting the looper guide to the carriage such that the looper is slidably guided in the holding guide.

3. The apparatus of claim 2 wherein the rotary carriage includes a projection, the sliding plate is provided with a groove, and the projection is slidably received in the groove.

4. The apparatus of claim 2 wherein the holding guide is provided with a guide hole, the looper being inserted into the hole.

5. The apparatus of claim 1 which further comprises a ball joint, the ball joint connecting the driving rod to the rocking arm.

6. The apparatus of claim 5 which further comprises: rocking means carried on the driving shaft and being connected to the other end of the driving rod.

7. The apparatus of claim 6 wherein the rocking arm includes a central pivot about which the rocking arm seesaws.

* * * * *